US011646532B1

(12) United States Patent
Beard et al.

(10) Patent No.: US 11,646,532 B1
(45) Date of Patent: May 9, 2023

(54) CONNECTOR RELEASE SYSTEM

(71) Applicant: Dell Products L.P., Round Rock, TX (US)

(72) Inventors: Neal Beard, Austin, TX (US); Shree Rathinasamy, Round Rock, TX (US); Kevin E. Locklear, Georgetown, TX (US)

(73) Assignee: Dell Products L.P., Round Rock, TX (US)

( * ) Notice: Subject to any disclaimer, the term of this patent is extended or adjusted under 35 U.S.C. 154(b) by 17 days.

(21) Appl. No.: 17/517,956

(22) Filed: Nov. 3, 2021

(51) Int. Cl.
*H01R 13/633* (2006.01)
*H01R 43/26* (2006.01)
*H01R 13/627* (2006.01)

(52) U.S. Cl.
CPC ..... *H01R 13/633* (2013.01); *H01R 13/6272* (2013.01); *H01R 43/26* (2013.01)

(58) Field of Classification Search
CPC ... H01R 13/6272; H01R 13/633; H01R 43/26
USPC ..... 439/352
See application file for complete search history.

(56) References Cited

U.S. PATENT DOCUMENTS 7,465,180 B2 * 12/2008 Kusuda ..... H01R 13/6272 439/352
7,686,638 B2 * 3/2010 Boyd ..... H01R 13/6272 439/352
7,892,012 B1 * 2/2011 Foung ..... H01R 13/6272 439/352
8,235,745 B1 * 8/2012 Armstrong ..... H01R 13/633 439/352
8,267,712 B2 * 9/2012 Huang ..... H01R 43/26 439/352
8,353,715 B1 * 1/2013 Zhou ..... H01R 13/6335 439/352
8,512,062 B1 * 8/2013 Zhou ..... H01R 13/635 439/352

(Continued)

OTHER PUBLICATIONS

Amazon.com, "iSelek RJ 45 CAT 6 UTP EZ Pass Thru Connectors, 8P 8C Ethernet Modular Plug for CAT5E and Category 6 Stranded and Solid Unshielded Wire and LAN Network Cable," 4 pages, retrieved from the Internet, https://www.amazon.com/dp/B08ZSTPZJV/ on Nov. 3, 2021.

*Primary Examiner* — Gary F Paumen
(74) *Attorney, Agent, or Firm* — Joseph Mencher

(57) ABSTRACT

A connector includes a connector base with a first end that may be inserted in a port, and a second end located opposite the connector base from the first end. A connector release tab extends from the connector base adjacent the first end and moves relative to the connector base. A connector securing feature on the connector release tab may engage a port to secure the connector base in that port. A connector release system includes a connector release linkage coupled to the connector release tab and extending through the connector base, and a connector release actuator adjacent the second end of the connector base and coupled to the connector release linkage. The connector release actuator may be actuated to move, via the connector release linkage, the connector release tab to disengage the connector securing feature from a port such that the connector base may be removed from that port.

20 Claims, 17 Drawing Sheets

(56) References Cited

U.S. PATENT DOCUMENTS

| | | | | |
|---|---|---|---|---|
| 2006/0089039 | A1* | 4/2006 | Caveney | H01R 13/6272 439/352 |
| 2011/0111617 | A1* | 5/2011 | Handshaw | H01R 43/26 439/352 |
| 2012/0088392 | A1* | 4/2012 | Wagner | H01R 13/6397 439/352 |
| 2014/0038448 | A1* | 2/2014 | Crain | G02B 6/3893 439/352 |

* cited by examiner

CONNECTOR RELEASE SYSTEM

BACKGROUND

The present disclosure relates generally to information handling systems, and more particularly to a connector release system for releasing a connector secured to an information handling system.

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Information handling systems such as server devices, networking devices, storage system, and/or other computing devices known in the art, are often coupled together using cables via connectors that are included on those cables and that couple to ports on the computing devices. For example, many computing devices are coupled together via RJ-45 cables that include RJ-45 connectors, which were developed as a standardized telecommunications coupling interface for connecting telephone networks. Such RJ-45 connectors include an RJ-45 connector release tab (e.g., a plastic tab extending from the RJ-45 connector) having an RJ-45 connector securing feature that engages the port on the computing device when the RJ-45 connector is positioned in that port, which operates to secure the RJ-45 connector in that port. A user may then remove that RJ-45 connector from that port by pressing the RJ-45 connector release tab with their finger in order to move that RJ-45 connector release tab, and with it the RJ-45 connector securing feature, such that the RJ-45 connector securing feature disengages from the port on the computing device, which allows the user to remove the RJ-45 connector from that port.

However, one of skill in the art in possession of the present disclosure will appreciate that the conventional RJ-45 connectors discussed above suffer from a number of issues. For example, RJ-45 connector release tabs often breaks off of the RJ-45 connector when a user attempts to actuate them to remove the RJ-45 connector from a port, which may prevent that RJ-45 connector from being subsequently secured to ports (e.g., when the RJ-45 connector securing feature breaks off with that RJ-45 connector release tab) or may require a tool (e.g., a screwdriver) in order to remove that RJ-45 connector from a port that it is subsequently secured to (e.g., when the RJ-45 connector securing feature remains after that RJ-45 connector release tab breaks off), and typically results in the corresponding RJ-45 cable being replaced, or in some cases connectivity issues/support calls when subsequently used in a port due to the issues described above. In another example, some ports on computing devices may be recessed and/or otherwise difficult to access, making the RJ-45 connector release tab (which is positioned immediately adjacent the port when the RJ-45 connector is secured to the port) difficult to access in order to remove its RJ-45 connector from those ports. In yet another example, the RJ-45 connector release tab mechanism/operation described above has ergonomic issues that can lead to hand fatigue, particularly is situations where a large number of RJ-45 connectors must be removed from corresponding ports in the same time period (e.g., when switch device(s) are decommissioned).

Accordingly, it would be desirable to provide a connector release system that addresses the issues described above.

SUMMARY

According to one embodiment, an Information Handling System (IHS) includes a chassis; a processing system that is housed in the chassis; a communication system that is housed in the chassis, that is coupled to the processing system, and that includes a port; and a cable that is coupled to the port via a connector, wherein the connector includes: a connector base including a first end that is inserted in the port, and a second end that is located opposite the connector base from the first end and that extends from the cable; a connector release tab that extends from the connector base adjacent the first end and that is configured to move relative to the connector base; a connector securing feature that is included on the connector release tab and that engages the port to secure the connector base in the port; and a connector release system that includes: a connector release linkage that is coupled to the connector release tab and that extends through the connector base; and a connector release actuator that is located adjacent the second end of the connector base and that is coupled to the connector release linkage, wherein the connector release actuator is configured to be actuated to move, via the connector release linkage, the connector release tab to disengage the connector securing feature from the port such that the connector base may be removed from the port.

DETAILED DESCRIPTION

For purposes of this disclosure, an information handling system may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, an information handling system may be a personal computer (e.g., desktop or laptop), tablet computer, mobile device (e.g., personal digital assistant (PDA) or smart phone), server (e.g., blade server or rack server), a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, touchscreen and/or a video display. The information handling system may also include one or more buses operable to transmit communications between the various hardware components.

Figure 1:
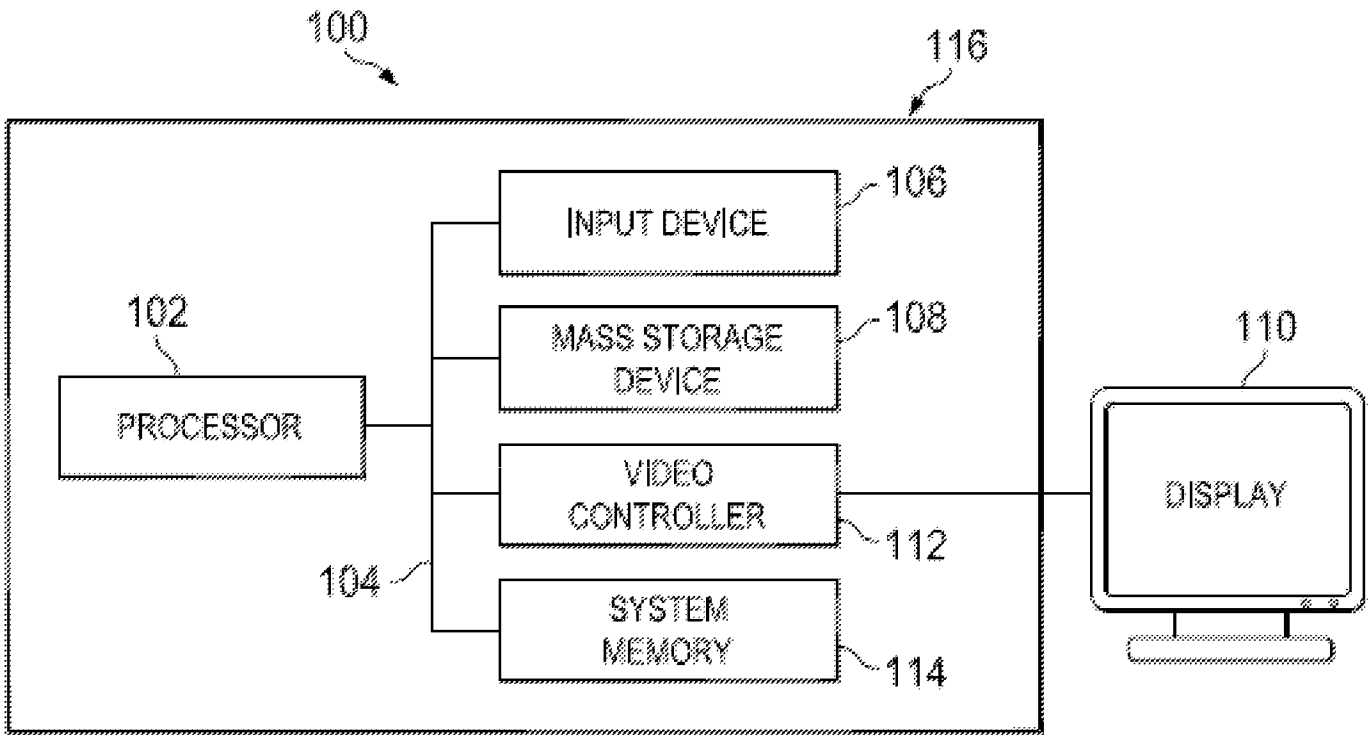
FIG. 1 is a schematic view illustrating an embodiment of an Information Handling System (IHS).

In one embodiment, IHS 100, FIG. 1, includes a processor 102, which is connected to a bus 104. Bus 104 serves as a connection between processor 102 and other components of IHS 100. An input device 106 is coupled to processor 102 to provide input to processor 102. Examples of input devices may include keyboards, touchscreens, pointing devices such as mouses, trackballs, and trackpads, and/or a variety of other input devices known in the art. Programs and data are stored on a mass storage device 108, which is coupled to processor 102. Examples of mass storage devices may include hard discs, optical disks, magneto-optical discs, solid-state storage devices, and/or a variety of other mass storage devices known in the art. IHS 100 further includes a display 110, which is coupled to processor 102 by a video controller 112. A system memory 114 is coupled to processor 102 to provide the processor with fast storage to facilitate execution of computer programs by processor 102. Examples of system memory may include random access memory (RAM) devices such as dynamic RAM (DRAM), synchronous DRAM (SDRAM), solid state memory devices, and/or a variety of other memory devices known in the art. In an embodiment, a chassis 116 houses some or all of the components of IHS 100. It should be understood that other buses and intermediate circuits can be deployed between the components described above and processor 102 to facilitate interconnection between the components and the processor 102.

Figure 2:
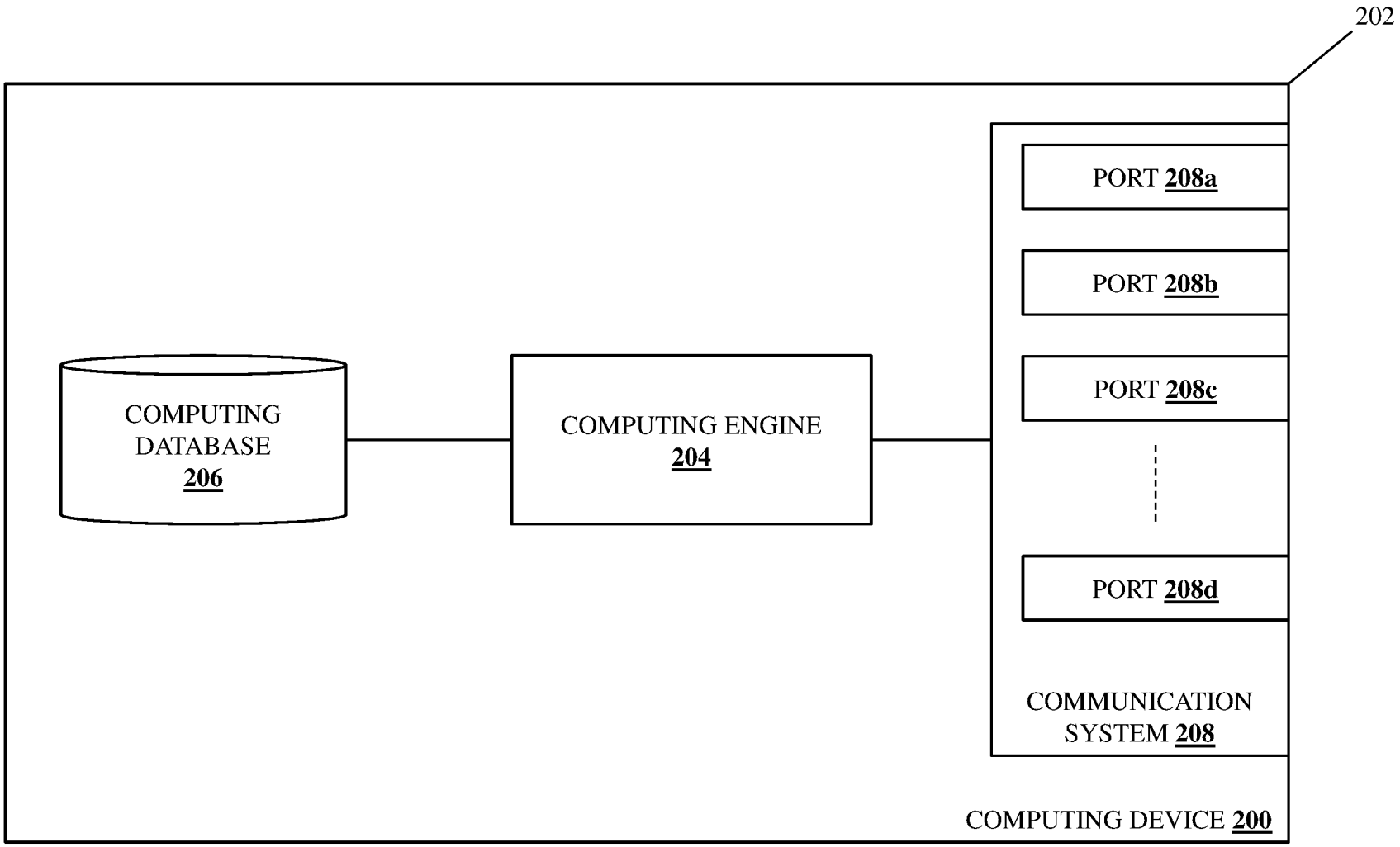
FIG. 2 is a schematic view illustrating an embodiment of a computing system that may couple to a cable including the connector release system of the present disclosure.

Referring now to FIG. 2, an embodiment of a computing device 200 is illustrated that may couple to a cable connector system including the connector release system of the present disclosure. As such, the computing device 200 may be provided by the IHS 100 discussed above with reference to FIG. 1 and/or may include some or all of the components of the IHS 100, and in specific examples may be provided by server devices, networking devices (e.g., switch devices), storage systems, and/or other computing devices that would be apparent to one of skill in the art in possession of the present disclosure. Furthermore, while illustrated and discussed as being provided by particular computing devices, one of skill in the art in possession of the present disclosure will recognize that the functionality of the computing device 200 discussed below may be provided by other devices that are configured to operate similarly as the computing device 200 discussed below. In the illustrated embodiment, the computing device 200 includes a chassis 202 that houses the components of the computing device 200, only some of which are illustrated and discussed below. For example, the chassis 202 may house a processing system (not illustrated, but which may include the processor 102 discussed above with reference to FIG. 1) and a memory system (not illustrated, but which may include the memory 114 discussed above with reference to FIG. 1) that is coupled to the processing system and that includes instructions that, when executed by the processing system, cause the processing system to provide a computing engine 204 that is configured to perform the functionality of a variety of computing engines and/or computing devices that would be apparent to one of skill in the art in possession of the present disclosure.

The chassis 202 may also house a storage system (not illustrated, but which may include the storage 108 discussed above with reference to FIG. 1) that is coupled to the computing engine 204 (e.g., via a coupling between the storage system and the processing system) and that includes a computing database 206 that is configured to store any information utilized by the computing engine 204. The chassis 202 may also house a communication system 208 that is coupled to the computing engine 204 (e.g., via a coupling between the communication system 208 and the processing system) and that may be provided by a Network Interface Controller (NIC), wireless communication systems (e.g., BLUETOOTH®, Near Field Communication (NFC) components, WiFi components, etc.), and/or any other communication components that would be apparent to one of skill in the art in possession of the present disclosure. In the specific examples provided below, the communication system 208 in the computing device 200 includes ports 208*a*, 208*b*, 208*c*, and up to 208*d* that are provided by female Ethernet/networking ports that receive RJ-45 connectors, but that may be provided by other types of ports while remaining within the scope of the present disclosure as well However, while a specific computing device 200 has been illustrated and described, one of skill in the art in possession of the present disclosure will recognize that computing devices (or other devices operating according to the teachings of the present disclosure in a manner similar to that described below for the computing device 200) may include a variety of components and/or component configurations for providing conventional computing device functionality, as well as the functionality discussed below, while remaining within the scope of the present disclosure as well.

Figure 3A:
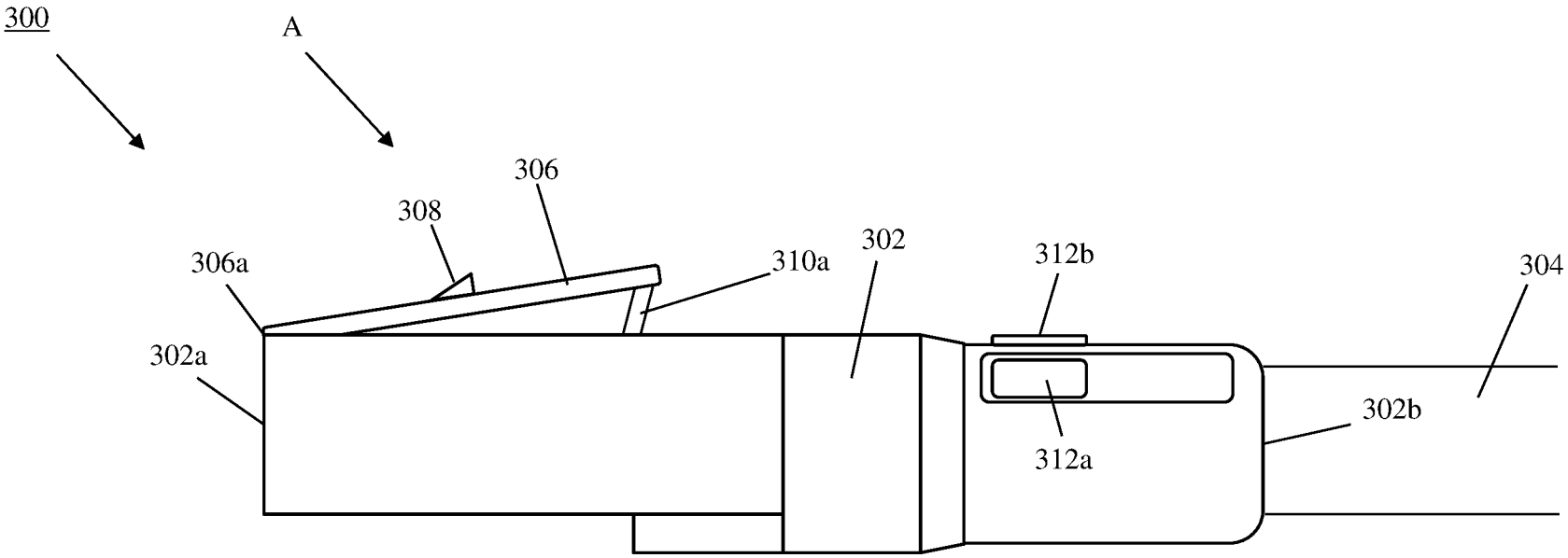
FIG. 3A is a schematic side view illustrating an embodiment of a cable connector system including the connector release system of the present disclosure.
Figure 3B:
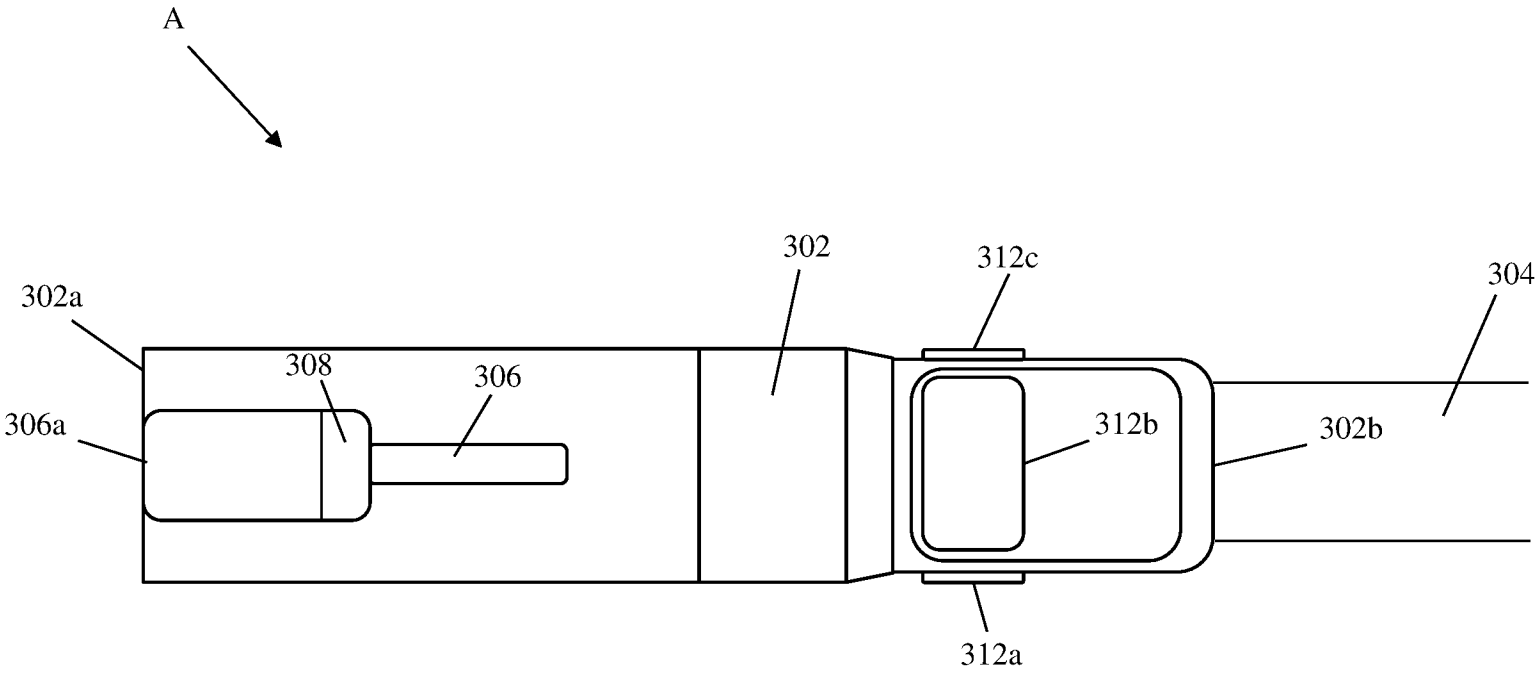
FIG. 3B is a schematic top view illustrating an embodiment of the cable connector system of FIG. 3A.
Figure 3C:
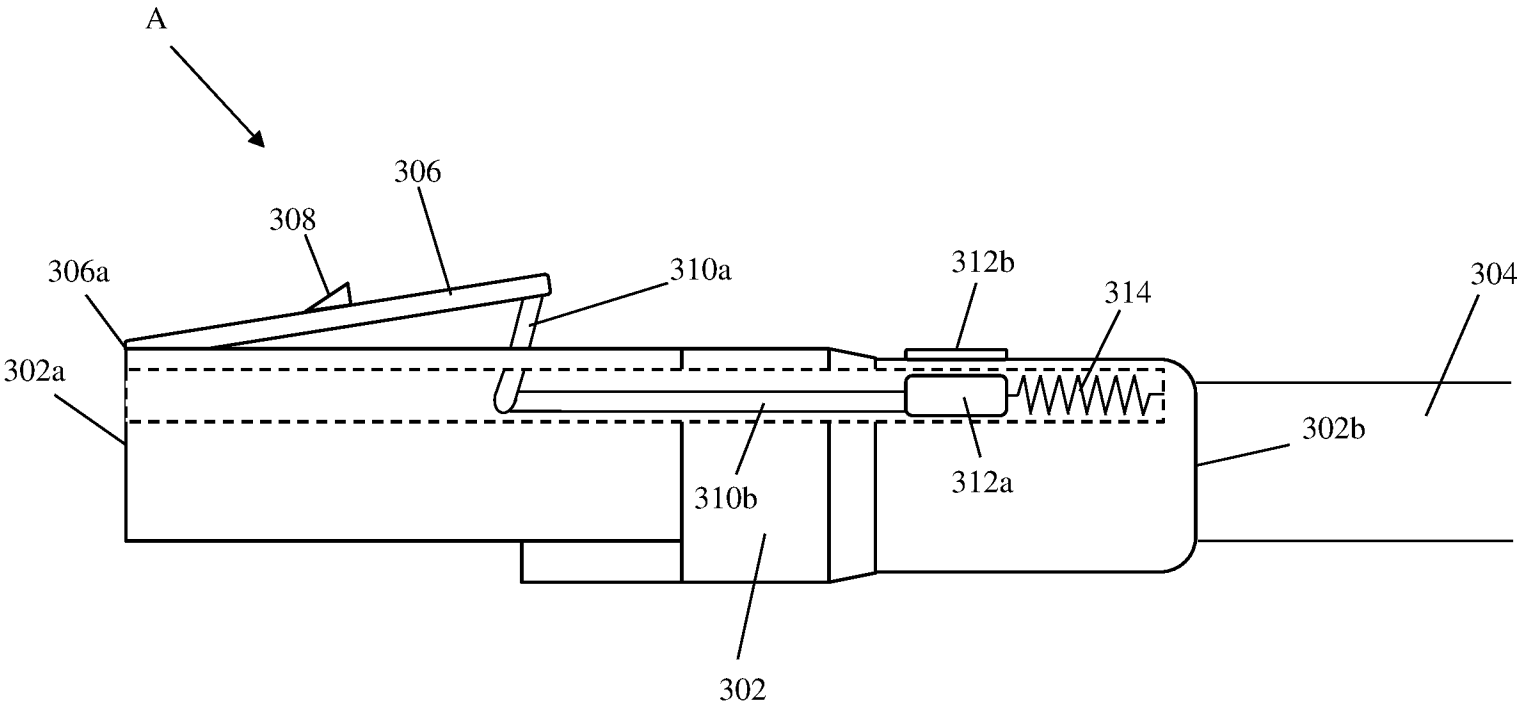
FIG. 3C is a schematic cut-away side view illustrating an embodiment of the cable connector system of FIG. 3A.

Referring now to FIGS. 3A, 3B, and 3C, an embodiment of a cable connector system 300 is illustrated that includes a connector base 302 having a front end 302*a* that is configured to be inserted in a port (e.g., one of the ports 208*a*-208*d* discussed above with reference to FIG. 2), and a rear end 302*b* that is located opposite the connector base 302 from the front end 302*a*. One of skill in the art in possession of the present disclosure will recognize that the connector base 302 is illustrated and described herein as an RJ-45 connector base, but will appreciate that other connector bases will fall within the scope of the present disclosure as well. A cable 304 extends from the second end 302*b* of the connector base 302, and one of skill in the art in possession of the present disclosure will recognize how the cable 304 may be coupled to the connector base 302 such that wiring and/or other communication conduits that extend through the cable 304 are coupled to wiring and/or other communication conduits that extend through the connector base 302, as well as to port connectors (not illustrated) that are included on or adjacent the first end 302*a* of the connector base 302. One of skill in the art in possession of the present disclosure will recognize that the cable 304 is illustrated and described herein as an Ethernet cable (i.e., a networking cable with RJ-45 connectors), but will appreciate that other cables will fall within the scope of the present disclosure as well.

A connector release tab 306 extends from the connector base 302 via a connector base connection 306*a* to the first end 302*a* of the connector base 302, and one of skill in the art in possession of the present disclosure will recognize how the connector base connection 306*a* allows the connector release tab 306 to move relative to the connector base 302. For example, the connector base connection 306*a* may be provided by plastic extension of the connector base 302, although one of skill in the art in possession of the present disclosure will appreciate how other movable connections may be utilized to provide the relative movement of the connector release tab 306 and the connector base 302 while remaining within the scope of the present disclosure. A connector securing feature 308 is included on the connector release tab 306 between the connector base connection 306*a* and a distal end of the connector release tab 306 that is located opposite the connector release tab from the connector base connection 306*a*, and one of skill in the art in possession of the present disclosure will appreciate how the connector securing feature 306*a* is configured to engage a port to secure the connector base 302 in that port, examples of which are described in further detail below.

The cable connector system 300 also include a connector release system that, as illustrated in FIG. 3C and in the specific examples provided herein, includes a connector release linkage having a link 310*a* that extends from the connector release tab 306 adjacent the distal end of the connector release tab 306 (i.e., opposite the connector release tab 306 from the connector base connection 306*a*), and a link 310*b* that extends through a portion of the connector base 302 between the link 310*a* and a connector release actuator system. In the embodiments illustrated and described herein, one end of the link 310*a* is pivotally connected to the connector release tab 306, and an opposite end of that link 310*a* is pivotally connected to an end the link 310*b*, with an opposite end of that link 310*b* mounted to the connector release actuator system. However, while a specific example of a connector release linkage is illustrated and described, one of skill in the art in possession of the present disclosure will appreciate how the connector release linkage may be configured in a variety of manners, or how the actuator system may be coupled to the connector release tab 306 in other manners, any of which will fall within the scope of the present disclosure as well.

In the illustrated embodiment, the connector release actuator system includes a first connector release actuator 312*a* that is accessible on a first side of the connector base 302, a second connector release actuator 312*b* that is accessible on a second side of the connector base 302, and a third connector release actuator 312*c* that is accessible on a third side of the connector base 302. However, while a specific example of an connector release actuator system that includes respective connector release actuators accessible on each of the "sides" and the "top" of the connector base 302 are illustrated and described, one of skill in the art in possession of the present disclosure will appreciate that different numbers of connector release actuators in the connector release actuator system may be accessible on the connector base 302 (e.g., only a single connector release actuator may be accessible on one of the "sides" or the "top" of the connector base 302, only two connector release actuators may be accessible on opposite the "sides" of the connector base 302, etc.) while remaining within the scope of the present disclosure as well. In the illustrated embodiment, a biasing member 314 (e.g., a spring in the illustrated example) extends between the connector base 302 and the connector release actuator system, and is configured to bias the connector release actuator system (e.g., the connector release actuator 312*a*, 312*b*, and 312*c* in the illustrated embodiment), the connector release linkage 310*a* and 310*b*, and the connector release tab 306 in a "securing" orientation A that is illustrated in FIGS. 3A, 3B, and 3C.

Figure 3D:
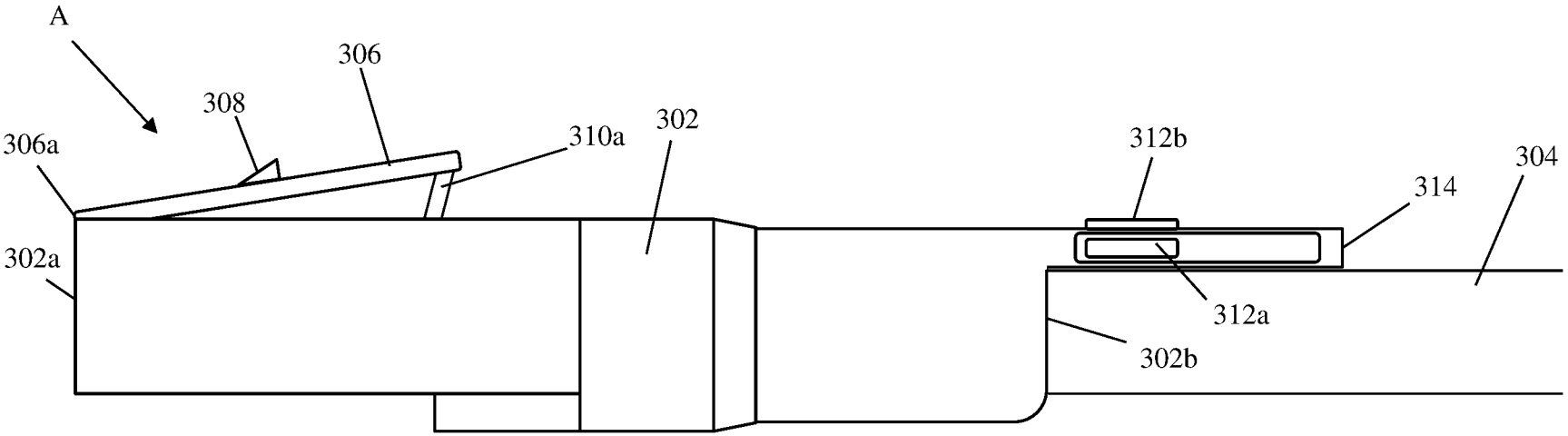
FIG. 3D is a schematic side view illustrating an embodiment of a cable connector system including the connector release system of the present disclosure.

However, while a specific example of a cable connector system 300 including the connector release system of the present disclosure has been illustrated and described with reference to FIGS. 3A, 3B, and 3C, one of skill in the art in possession of the present disclosure will appreciate how other embodiments of the connector release system of the present disclosure may include different features, components, and/or configurations. For example, the embodiments illustrated in FIGS. 3A, 3B, and 3C provide the connector release actuator system (e.g., the connector release actuators 312*a*, 312*b*, and 312*c* in the illustrated embodiment) accessible opposite the second end 302*b* of the connector base 302 from the cable 304. However, FIG. 3D illustrates how the connector release actuator system may include a connector release actuator base 314 that extends from the second end 302*b* of the connector base 302 and over a portion of the cable 314 such that the connector release actuator system (e.g., the connector release actuators 312*a*, 312*b*, and 312*c* in the illustrated embodiment) is accessible on the same side of the second end 302*b* of the connector base 302 as the cable 304. As such, one of skill in the art in possession of the present disclosure will appreciate how a wide variety of modification to the cable connector system 300 will fall within the scope of the present disclosure.

Figure 4:
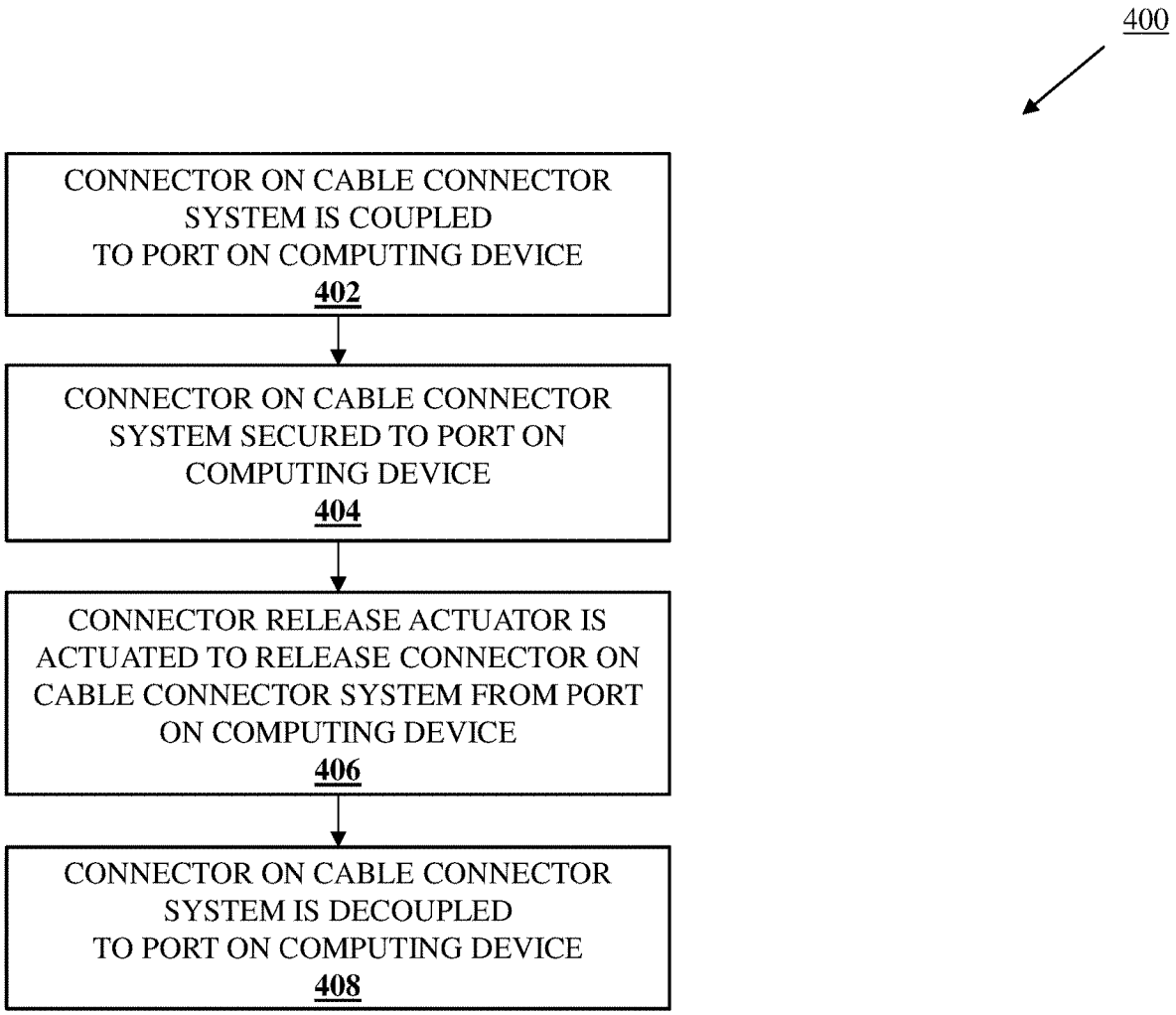
FIG. 4 is a flow chart illustrating an embodiment of a method for releasing a connector.

Referring now to FIG. 4, an embodiment of a method 400 for releasing a connector is illustrated. As discussed below, the systems and methods of the present disclosure provide for the release of connectors from ports via a connector release system that includes a connector release linkage that couples the connector release tab on a front end the connector to a connector release actuator located on a rear end of the connector. For example, the connector of the present disclosure may include a connector base with a first end that may be inserted in a port, and a second end located opposite the connector base from the first end. A connector release tab extends from the connector base adjacent the first end and moves relative to the connector base. A connector securing feature on the connector release tab may engage a port to secure the connector base in that port. A connector release system includes a connector release linkage coupled to the connector release tab and extending through the connector base, and a connector release actuator adjacent the second end of the connector base and coupled to the connector release linkage. The connector release actuator may be actuated to move, via the connector release linkage, the connector release tab to disengage the connector securing feature from a port such that the connector base may be removed from that port. As such, issues associated with conventional connectors such as RJ-45 connectors are eliminated.

Figure 5A:
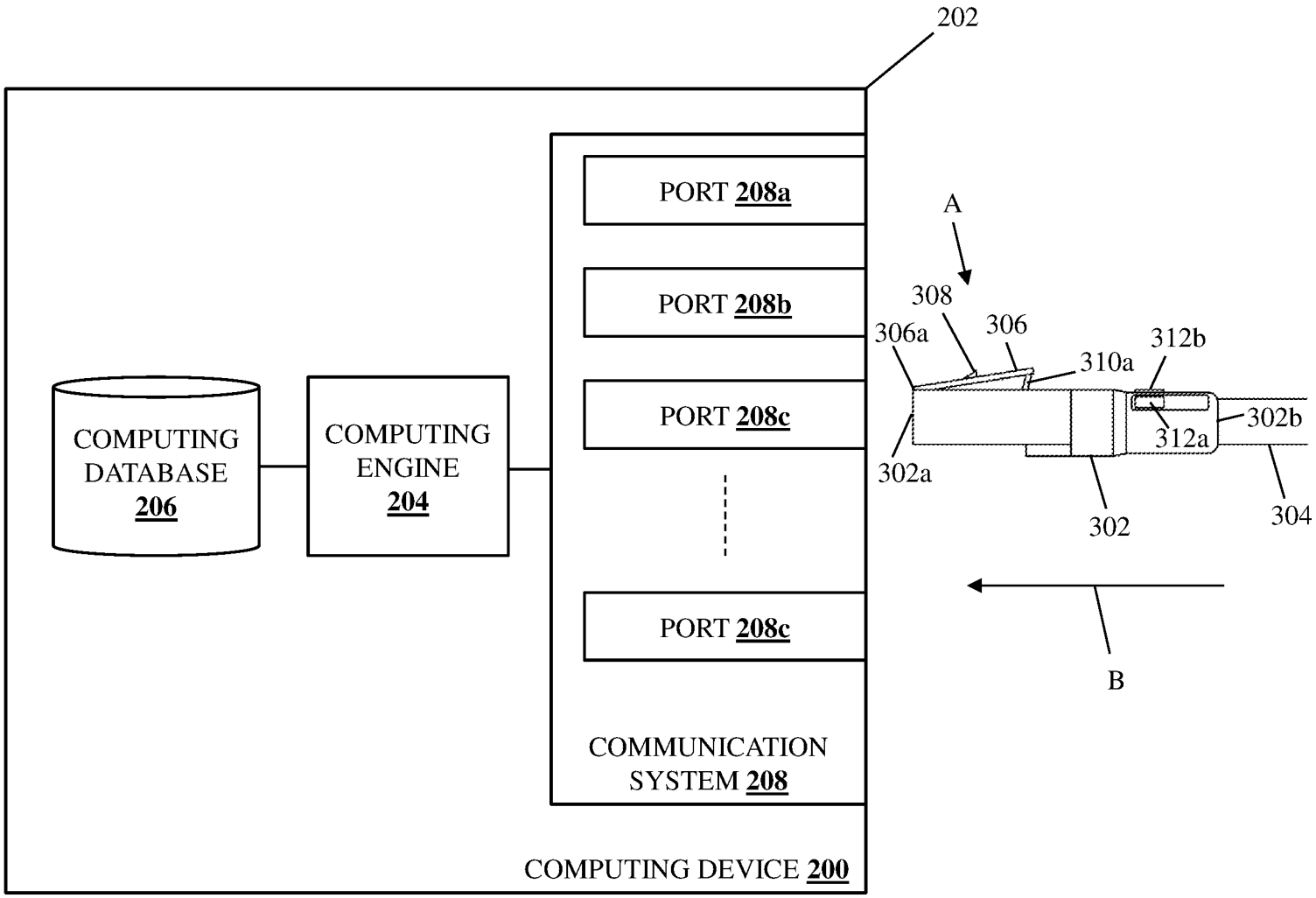
FIG. 5A is a schematic view illustrating an embodiment of the cable connector system of FIGS. 3A-3C being coupled to the computing system of FIG. 2 during the method of FIG. 4.
Figure 5B:
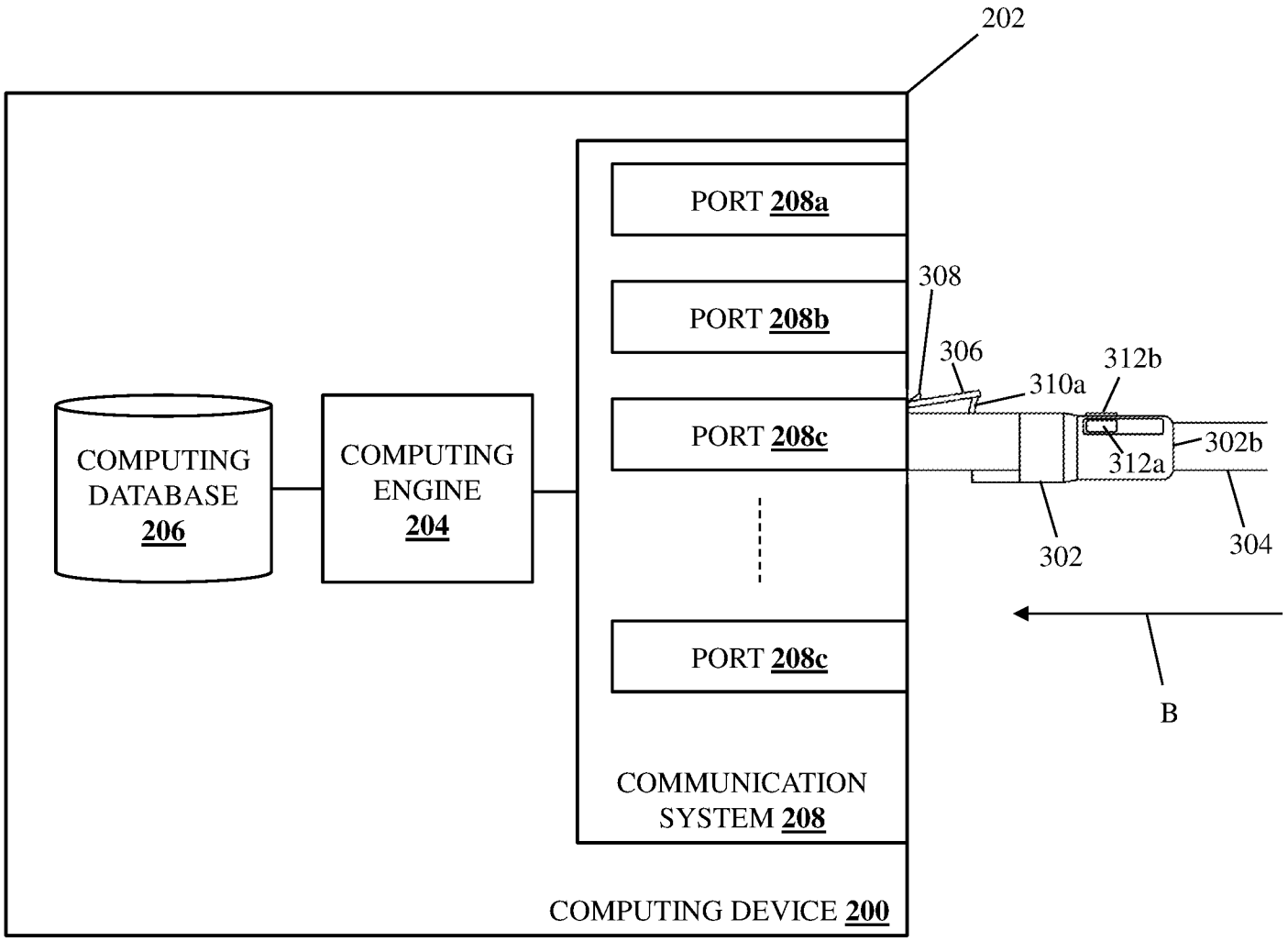
FIG. 5B is a schematic view illustrating an embodiment of the cable connector system of FIGS. 3A-3C being coupled to the computing system of FIG. 2 during the method of FIG. 4.
Figure 5C:
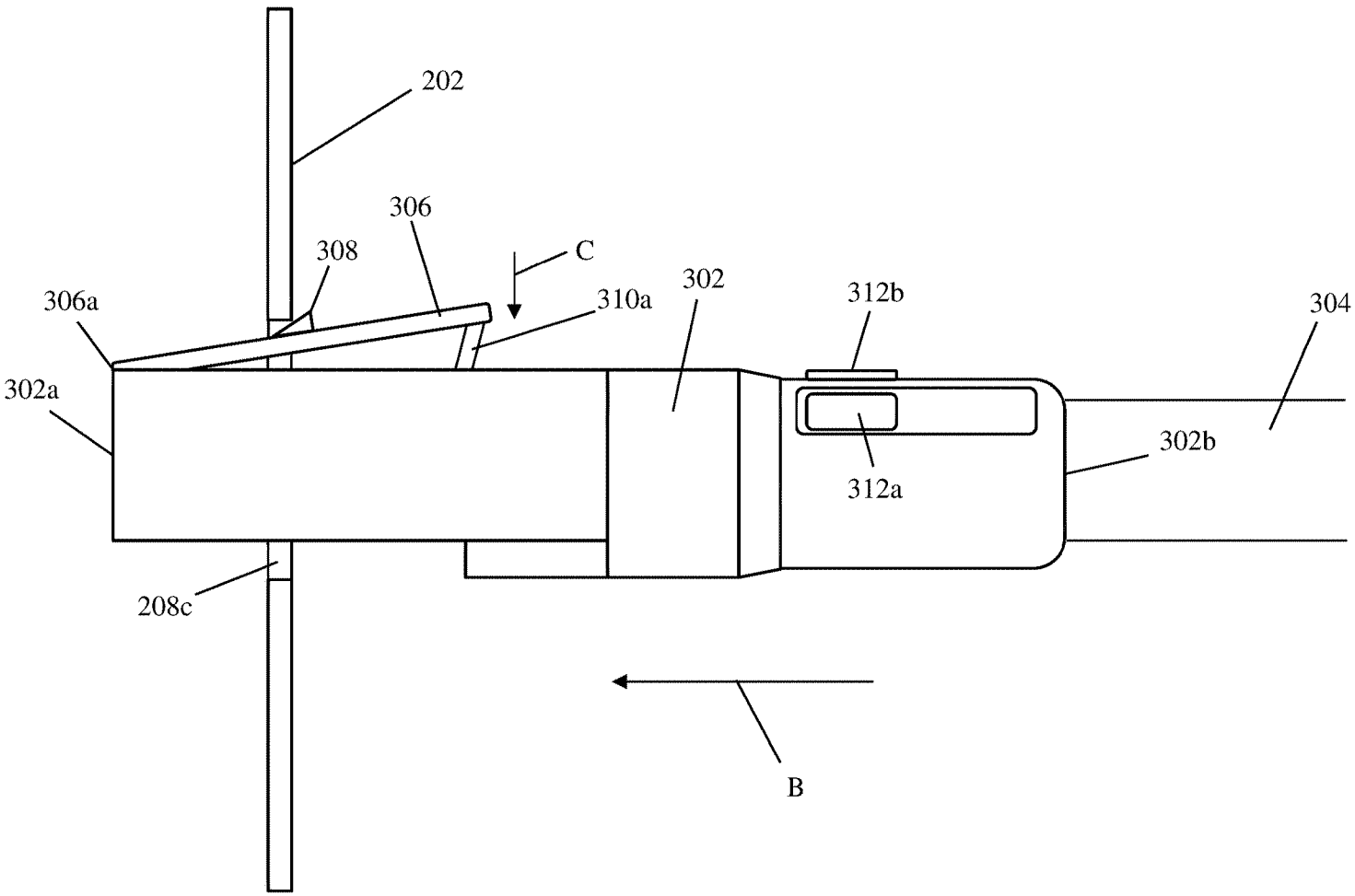
FIG. 5C is a schematic view illustrating an embodiment of the cable connector system of FIGS. 3A-3C being coupled to the computing system of FIG. 2 during the method of FIG. 4.
Figure 5D:
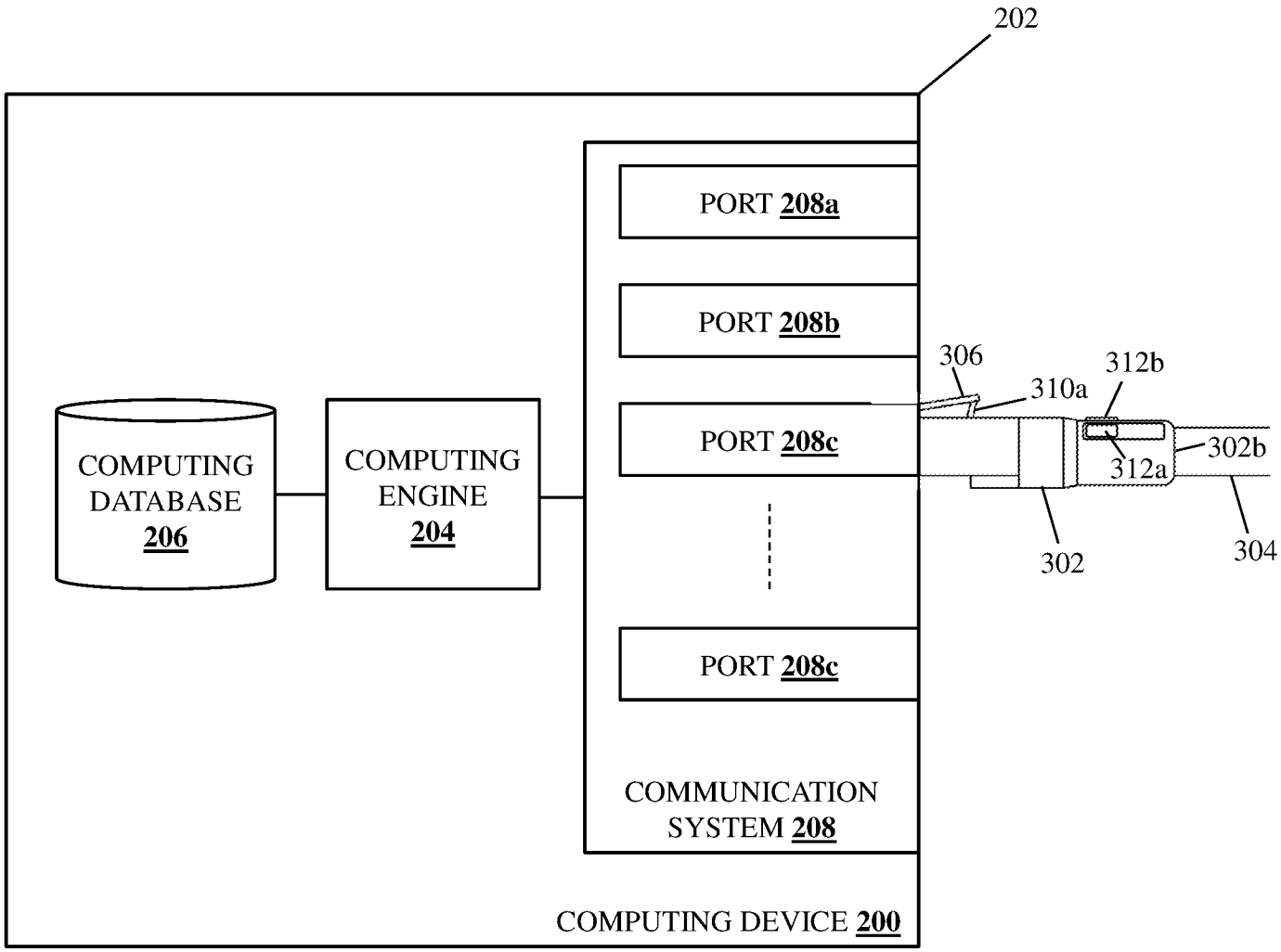
FIG. 5D is a schematic view illustrating an embodiment of the cable connector system of FIGS. 3A-3C secured to the computing system of FIG. 2 during the method of FIG. 4.
Figure 5E:
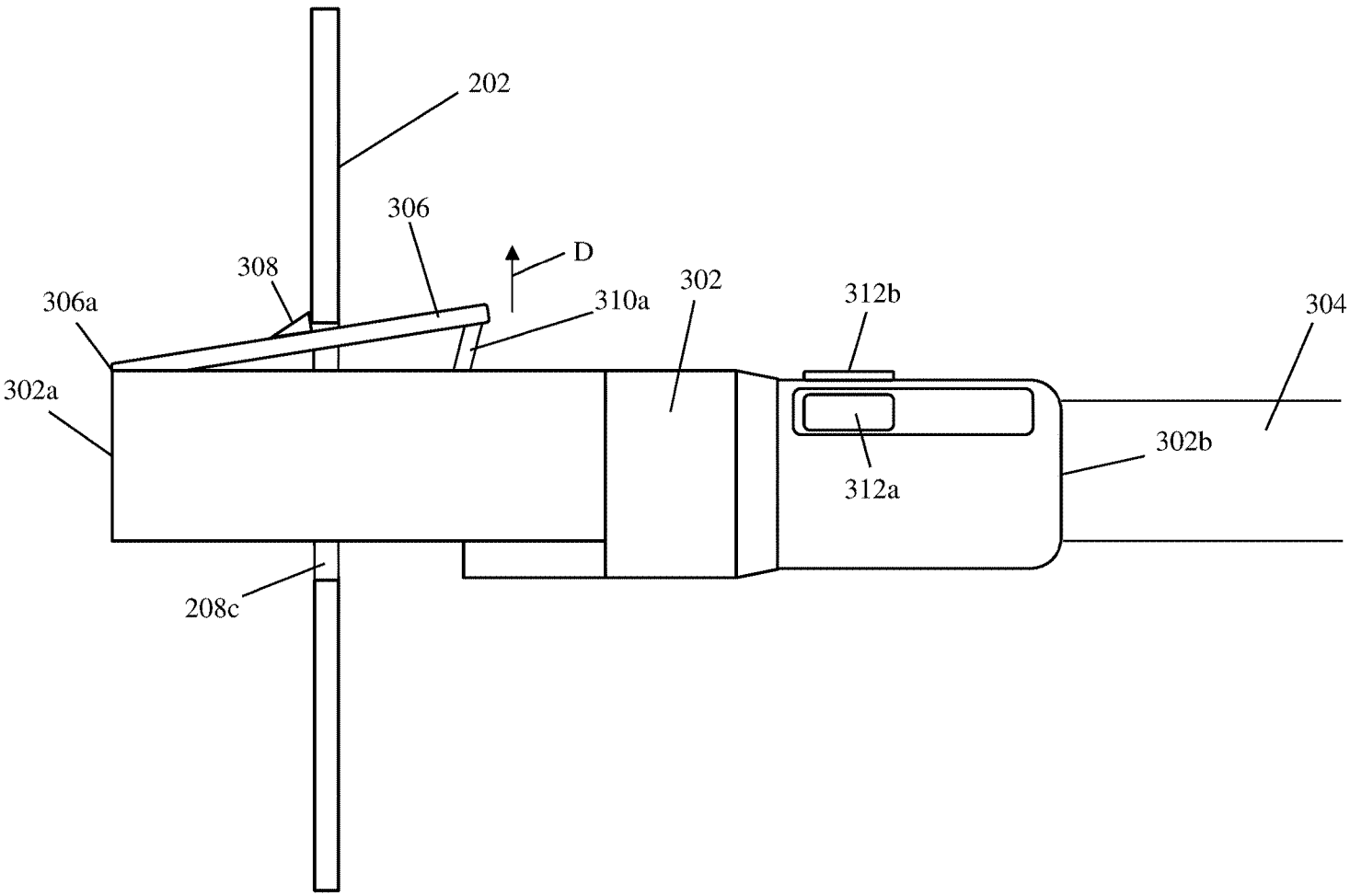
FIG. 5E is a schematic view illustrating an embodiment of the cable connector system of FIGS. 3A-3C secured to the computing system of FIG. 2 during the method of FIG. 4.

The method 400 begins at block 402 where a connector on a cable connector system is coupled to a port on a computing device. As will be appreciated by one of skill in the art in possession of the present disclosure, a user of the computing device 200 may wish to connect the computing device 200 to another device and, as such, may connect the cable connector system 300 to the computing device 200 (as well as to that other device). With reference to FIG. 5A, in an embodiment of block 402, a user may position the cable connector system 300 adjacent the port 208*c* on the computing device 200 such that the front end 302*a* of the connector base 302 is located adjacent the port 208*c*, with the biasing member 314 biasing the connector release actuator system (e.g., the connector release actuator 312*a*, 312*b*, and 312*c* in the illustrated embodiment), the connector release linkage 310*a* and 310*b*, and the connector release tab 306 in the "securing" orientation A illustrated in FIGS. 3A, 3B, and 3C (as well as in FIG. 5A). With reference to FIGS. 5A and 5B, the user may then move the cable connector system 300 in a direction B and toward the port 208*c* such that the front end 302*a* of the connector base 302 enters the port 208*c*.

The method 400 then proceeds to block 404 where the connector on the cable connector system is secured to the port on the computing device. With reference to FIGS. 5B, 5C, 5D, and 5E, in an embodiment of block 404, continued movement of the cable connector system 300 in the direction B results in the connector securing feature 308 engaging the port 208*c*, and further movement of the cable connector system 300 in the direction B will overcome the biasing force provided by the biasing member 314 on the connector release actuator system (e.g., the connector release actuator 312*a*, 312*b*, and 312*c* in the illustrated embodiment), the connector release linkage 310*a* and 310*b*, and the connector release tab 306 such that the connector release tab 306 moves in a direction C (illustrated in FIG. 5C) until it clears initial securing features on the port 208*c* to allow the connector base 302 to move further into the port 208*c* (illustrated in FIG. 5D) until the connector securing feature 308 has moved far enough into the port 208*c* such that it has cleared final securing features on the port 208*c* and the connector release tab 306 may move in a direction D (illustrated in FIG. 5E) to allow the connector securing feature 308 to engage those final securing features on the port 208*c* and secure the connector base 302 in the port 208*c*. As will be appreciated by one of skill in the art in possession of the present disclosure, with the engagement of the connector securing feature 308 the final securing features on the port 208*c* will resist movement of the connector base 302 out of the port 208*c*.

Figure 6A:
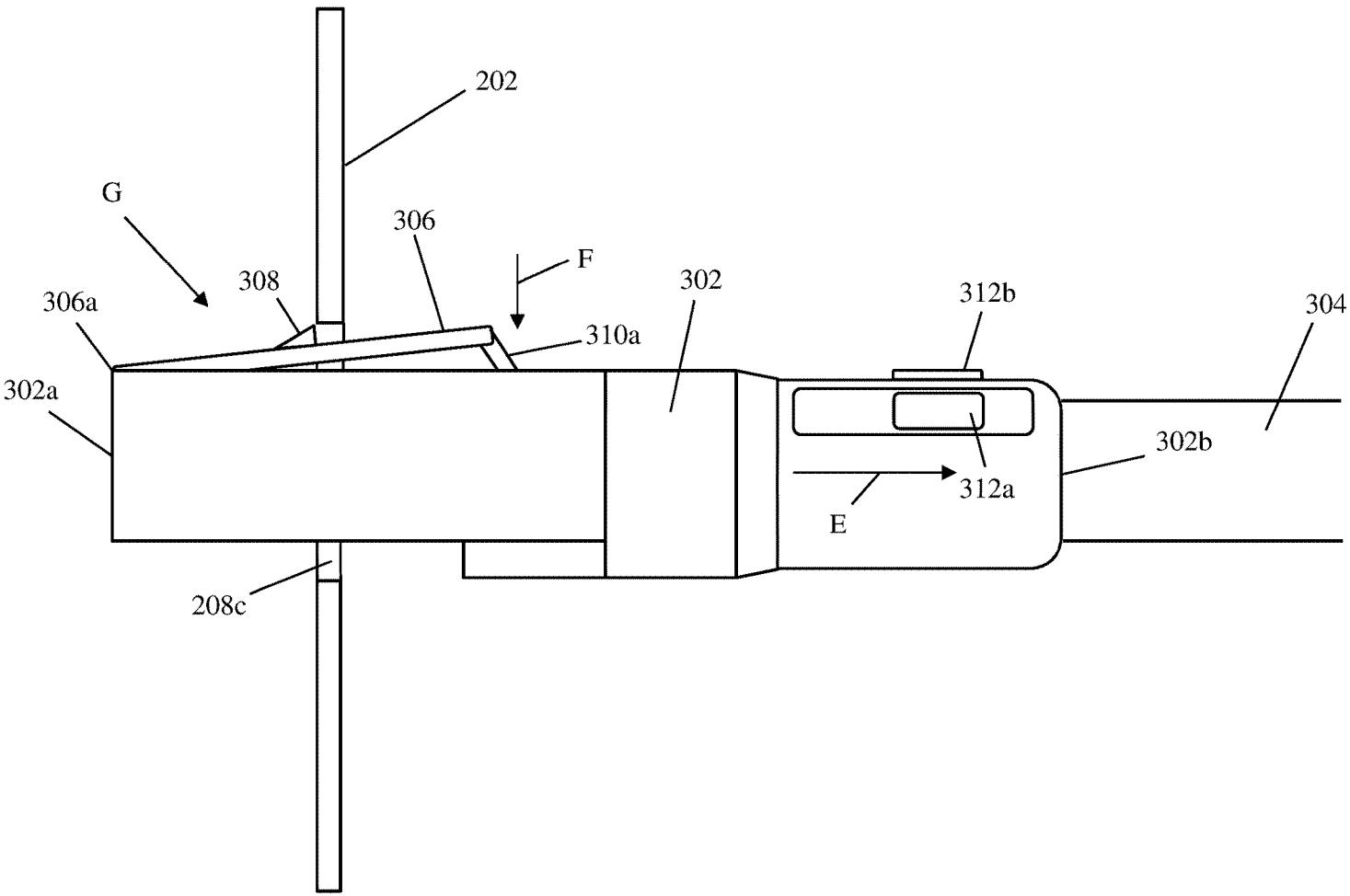
FIG. 6A is a schematic view illustrating an embodiment of the cable connector system of FIGS. 3A-3C being decoupled from the computing system of FIG. 2 during the method of FIG. 4.
Figure 6B:
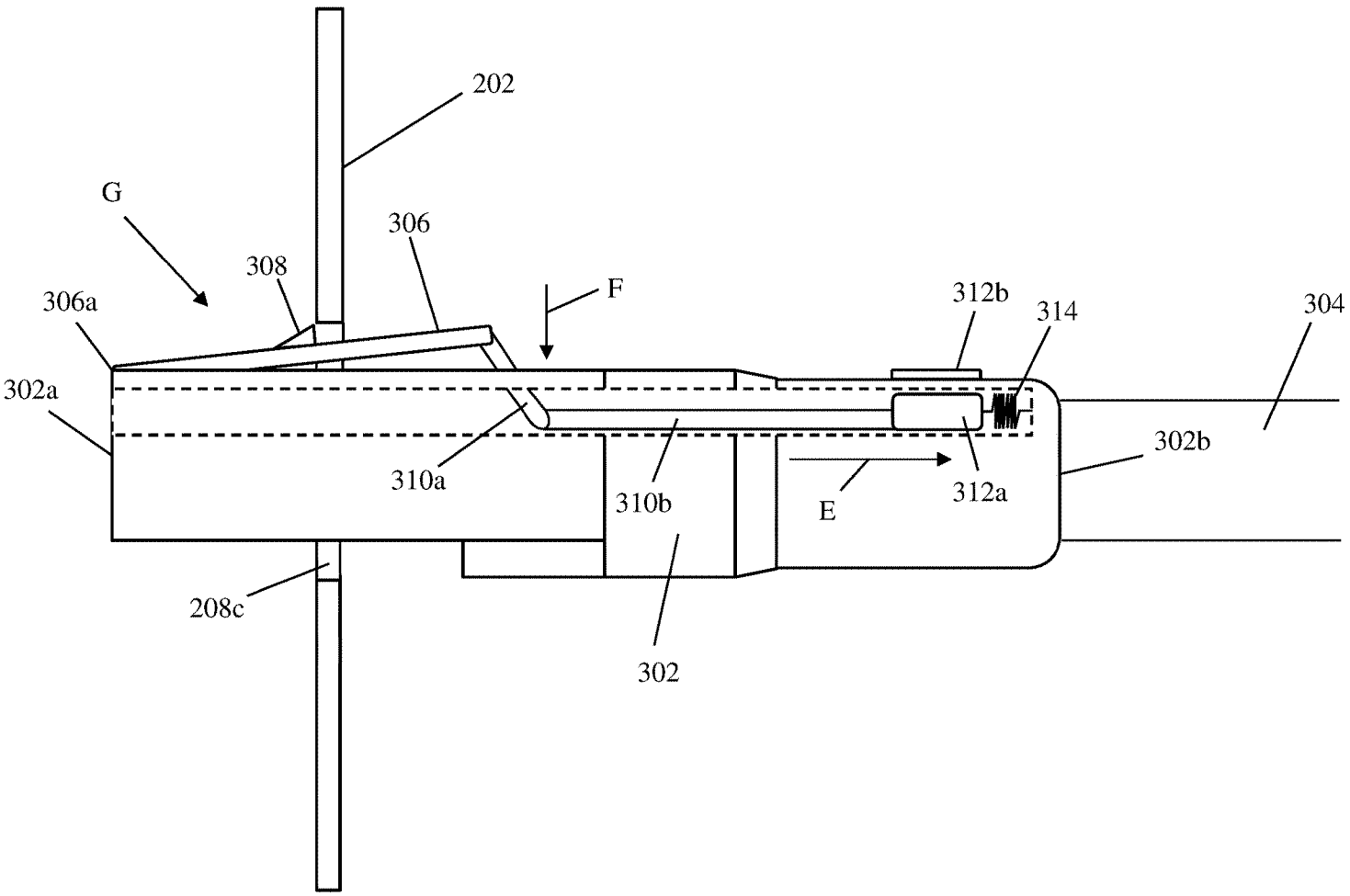
FIG. 6B is a schematic view illustrating an embodiment of the cable connector system of FIGS. 3A-3C being decoupled from the computing system of FIG. 2 during the method of FIG. 4.

The method 400 then proceeds to block 406 where a connector release actuator is actuated to release the connector on the cable connector system from the port on the computing device. As will be appreciated by one of skill in the art in possession of the present disclosure, a user of the computing device 200 may wish to disconnect the computing device 200 from another device to which it was connected at blocks 402 and 404 as discussed above and, as such, may disconnect the cable connector system 300 from the computing device 200 (as well as from that other device). With reference to FIGS. 6A and 6B, in an embodiment of block 406, the user may apply a force in a direction E on the any of the connector release actuators 312*a*, 312*b*, and/or 312*c* in order to overcome the biasing force provided by the biasing member 314 on the connector release actuator system (e.g., the connector release actuator 312*a*, 312*b*, and 312*c* in the illustrated embodiment), the connector release linkage 310*a* and 310*b*, and the connector release tab 306, with operates to move those connector release actuator(s) in the direction E.

As can be seen in FIGS. 6A and 6B, actuation/movement of the connector release actuators 312*a*, 312*b*, and/or 312*c* in the direction E causes moves the link 310*b* in the direction E, which in turn causes the link 310*a* to move the connector release tab 306 in a direction F and into a "release" orientation G due to the pivotal connections between the link 310*a* and each of the link 310*b* and the connector release tab 306. However, as discussed above, while a specific example of the coupling of the connector release actuator 312*a*, 312*b*, and 312*c* to the connector release tab 306 via the connector release linkage 310*a* and 310*b* that allows actuation/movement of the connector release actuators 312*a*, 312*b*, and/or 312*c* to move the connector release actuator 312*a*, 312*b*, and 312*c*, the connector release linkage 310*a* and 310*b*, and the connector release tab 306 from a "securing" orientation to a "release" orientation has been described, other connector release linkage configurations and/or other connector release actuator/connector release tab couplings will fall within the scope of the present disclosure as well. One of skill in the art in possession of the present disclosure will appreciate how, with the connector release actuator 312*a*, 312*b*, and 312*c*, the connector release linkage 310*a* and 310*b*, and the connector release tab 306 in the "release" orientation, the connector securing feature 308 may move past and "clear" the final securing features on the port 208*c* to release the connector base 302 from the port 208*c* (i.e., because the connector base 302 may now be moved out of the port 208*c* as discussed below).

The method 400 then proceeds to block 408 where the connector on the cable connector system is decoupled from the port on the computing device. With reference to FIGS.

Figure 6C:
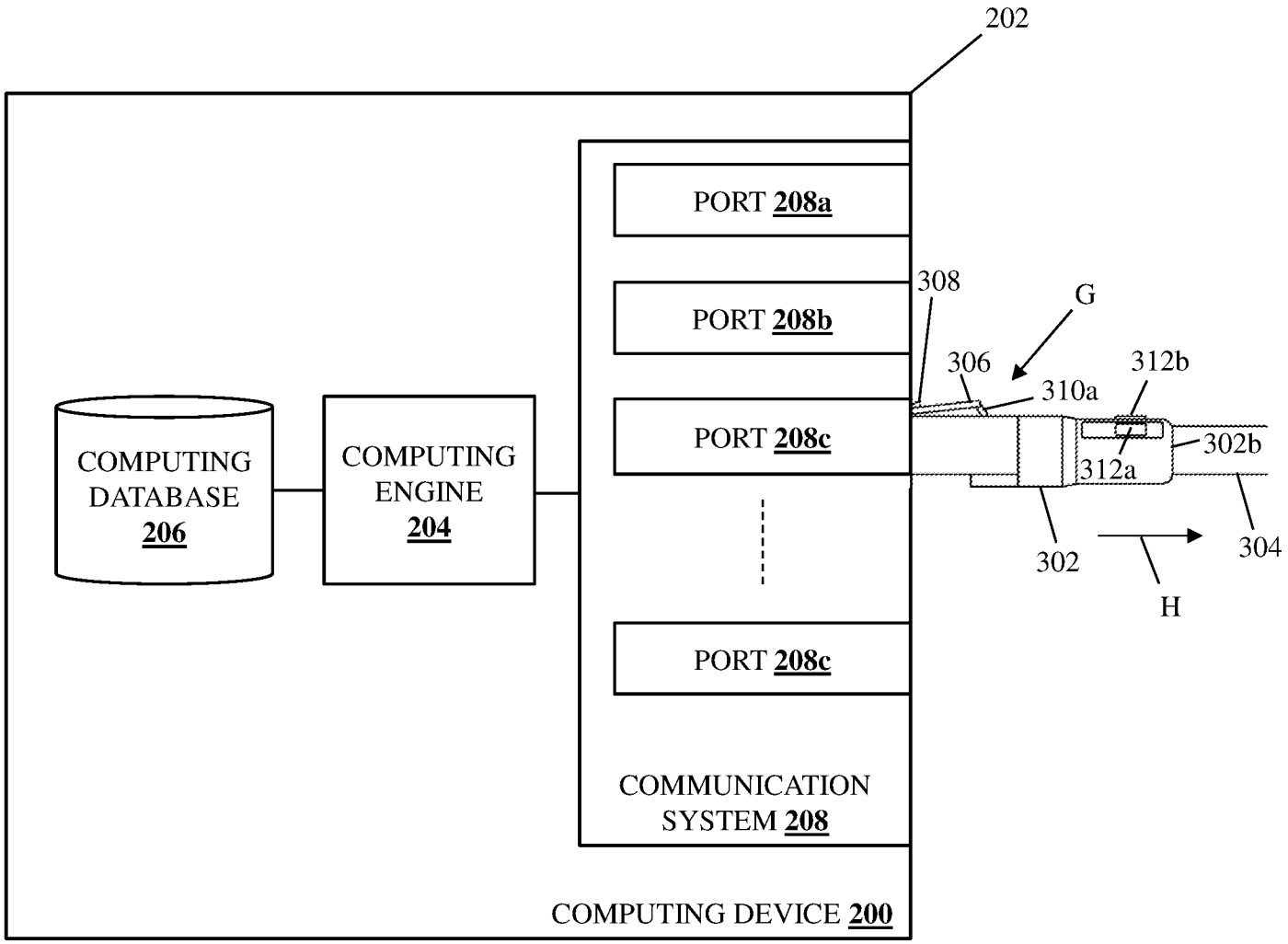
FIG. 6C is a schematic view illustrating an embodiment of the cable connector system of FIGS. 3A-3C being decoupled from the computing system of FIG. 2 during the method of FIG. 4.
Figure 6D:
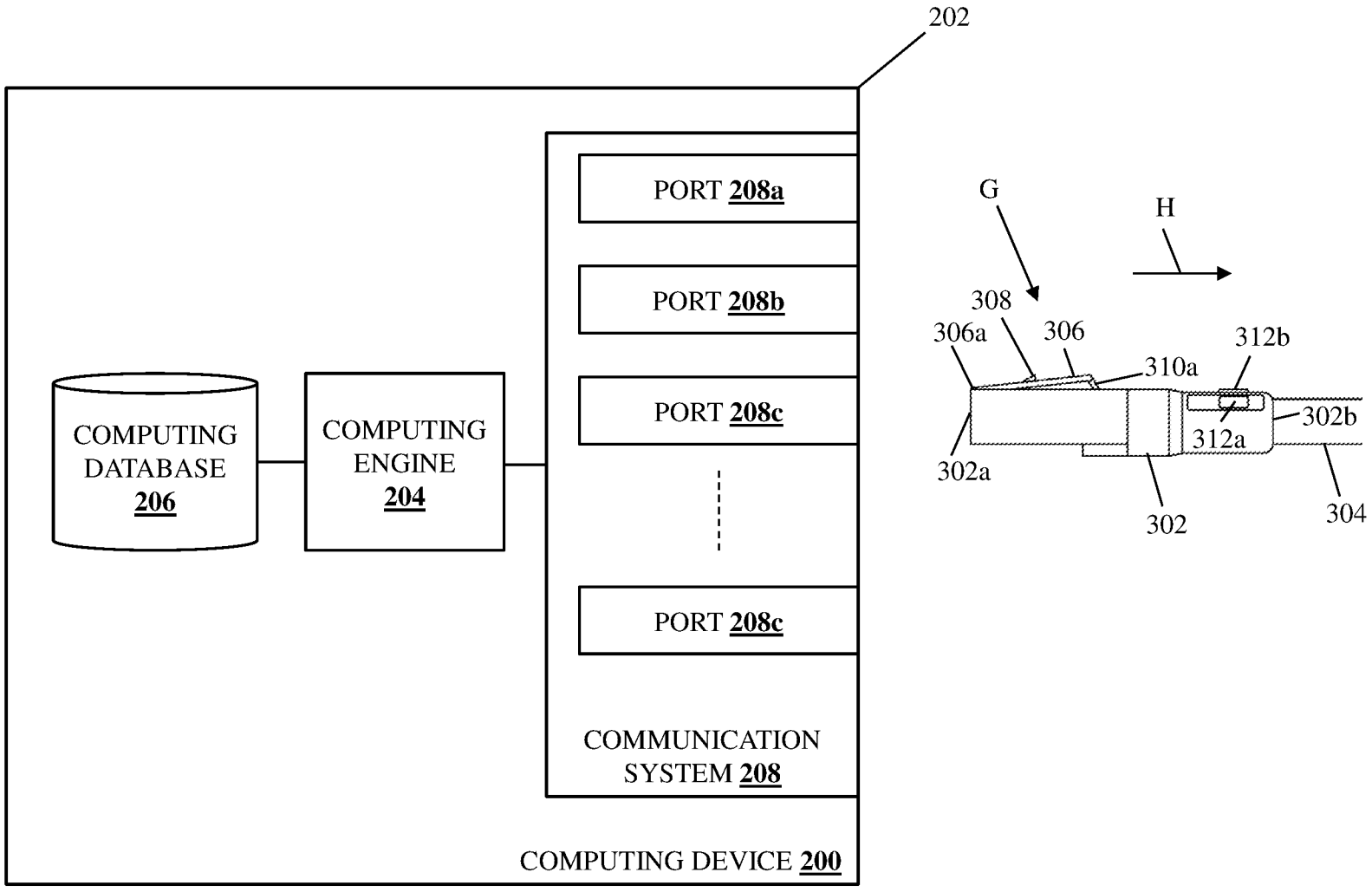
FIG. 6D is a schematic view illustrating an embodiment of the cable connector system of FIGS. 3A-3C decoupled from the computing system of FIG. 2 during the method of FIG. 4.
Figure 6E:
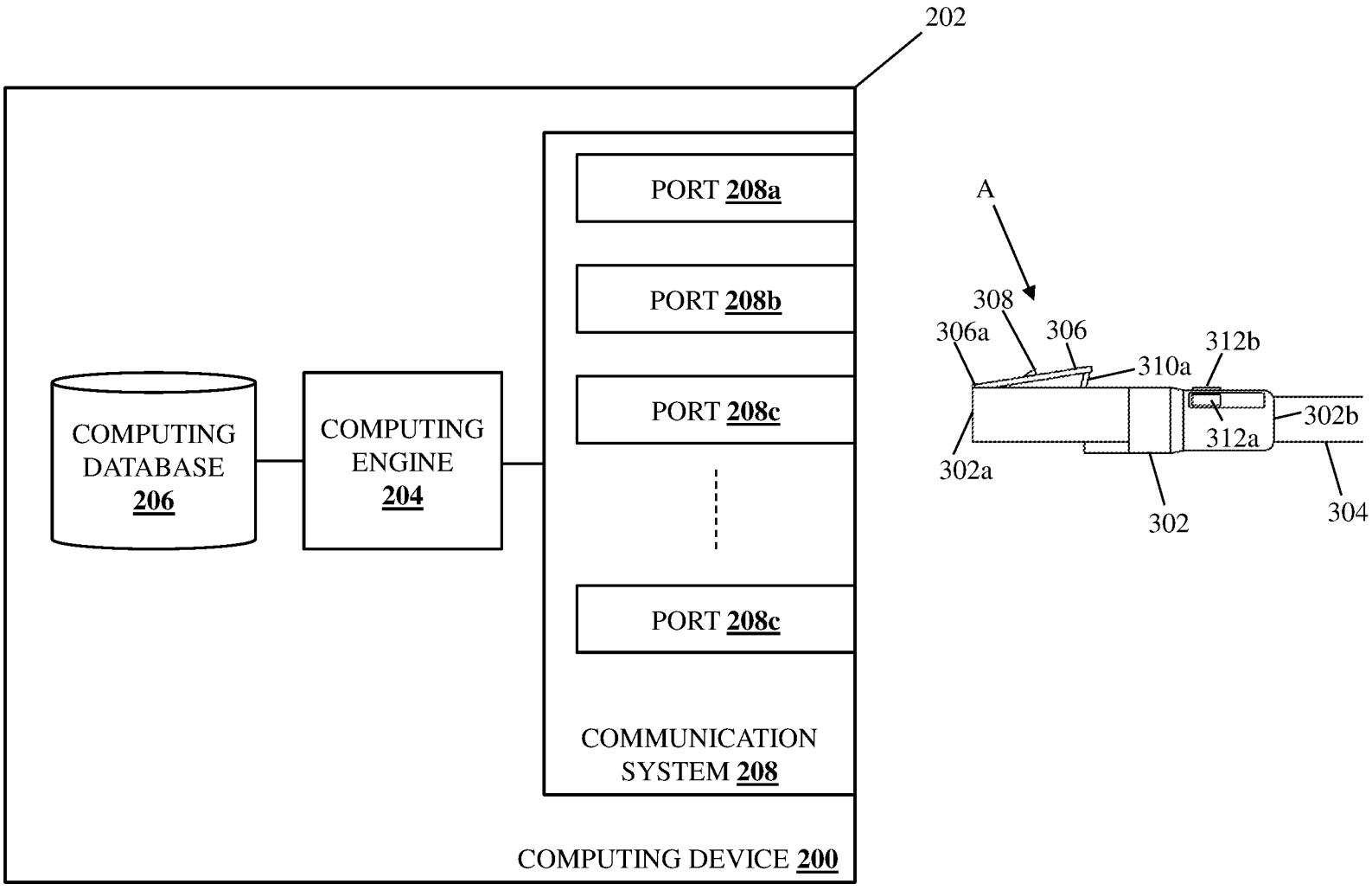
FIG. 6E is a schematic view illustrating an embodiment of the cable connector system of FIGS. 3A-3C decoupled from the computing system of FIG. 2 during the method of FIG. 4.

6C and 6D, in an embodiment of block 408, with the connector release actuators 312*a*, 312*b*, and/or 312*c* actuated/moved in the direction E, the user may then move the cable connector system 300 in a direction G such that the connector securing feature 308 clears the final securing features and the initial securing features on the port 208*c* (as illustrated in FIG. 6C), which allows the user to continue to move the cable connector system 300 in the direction G until the front end 302*a* of the connector base 302 exits the port 208*c* (as illustrated in FIG. 6D). As can be seen in FIG. 6E, the user may then release the connector release actuators 312*a*, 312*b*, and/or 312*c*, which allows the biasing member 314 to again bias the connector release actuator system (e.g., the connector release actuator 312*a*, 312*b*, and 312*c* in the illustrated embodiment), the connector release linkage 310*a* and 310*b*, and the connector release tab 306 back into the "securing" orientation A illustrated in FIGS. 3A, 3B, and 3C (as well as FIG. 6E), which one of skill in the art in possession of the present disclosure will appreciate allows the cable connector system 300 to subsequently be secured to port as described above with reference to blocks 402 and 404.

Thus, systems and methods have been described that provide for the release of RJ-45 connectors from Ethernet ports via an RJ-45 connector release system that couples an RJ-45 connector release tab on a front end the RJ-45 connector to an RJ-45 connector release actuator located on a rear end of the RJ-45 connector via an RJ-45 connector release linkage. For example, the RJ-45 connector of the present disclosure may include an RJ-45 connector base with a first end that may be inserted in an Ethernet port, and a second end located opposite the RJ-45 connector base from the first end. An RJ-45 connector release tab extends from the RJ-45 connector base adjacent the first end and moves relative to the RJ-45 connector base. An RJ-45 connector securing feature on the RJ-45 connector release tab may engage an Ethernet port to secure the RJ-45 connector base in that Ethernet port. An RJ-45 connector release system includes an RJ-45 connector release linkage coupled to the RJ-45 connector release tab and extending through the RJ-45 connector base, and an RJ-45 connector release actuator adjacent the second end of the RJ-45 connector base and coupled to the RJ-45 connector release linkage. The RJ-45 connector release actuator may be actuated to move, via the RJ-45 connector release linkage, the RJ-45 connector release tab to disengage the RJ-45 connector securing feature from an Ethernet port such that the RJ-45 connector base may be removed from that Ethernet port.

As will be appreciated by one of skill in the art in possession of the present disclosure, the connector release system of the present disclosure provides several benefits over conventional connector systems. For example, the connector release tab of the present disclosure is less likely to break off of the connector due to their actuation via the connector release actuator system of the present disclosure that does not require direct engagement of the user's finger with the connector release tab, thus eliminating the issues discussed above with connecting connectors having broken connector release tabs to ports that typically result in cable replacement and/or support calls Furthermore, the connector release system of the present disclosure provides for easier release of connectors when ports on computing devices are recessed and/or otherwise difficult to access due to the positioning of the connector release actuator system adjacent the rear end of the connector base. Further still, the connector release system of the present disclosure provides ergonomic improvements over conventional connector release systems, reducing hand fatigue in situations where a large number of RJ-45 connectors must be removed from corresponding ports in the same time period (e.g., when switch device(s) are decommissioned). However, while a few specific examples are provided, one of skill in the art in possession of the present disclosure will recognize other benefits of the present disclosure as well.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. A connector, comprising:

a connector base including a first end that is configured to be inserted in a port, and a second end that is located opposite the connector base from the first end;

a connector release tab that extends from the connector base adjacent the first end and that is configured to move relative to the connector base;

a connector securing feature that is included on the connector release tab and that is configured to engage a port to secure the connector base in that port; and a connector release system that includes:

a connector release linkage that is coupled to the connector release tab and that extends through the connector base; and a connector release actuator that is located adjacent the second end of the connector base and that is coupled to the connector release linkage, wherein the connector release actuator is configured to be actuated to move, via the connector release linkage, the connector release tab to disengage the connector securing feature from a port such that the connector base may be removed from that port.

2. The connector of claim 1, wherein the connector release system includes:

a connector release actuator biasing member that is configured to bias the connector release actuator, the connector release linkage, and the connector release tab into a securing orientation that allows the connector securing feature to engage a port to secure the connector base in that port.

3. The connector of claim 2, wherein the actuation of the connector release actuator overcomes a biasing force provided by the connector release actuator biasing member and moves the connector release actuator, the connector release linkage, and the connector release tab into a release orientation that disengages the connector securing feature from a port such that the connector base may be removed from that port.

4. The connector of claim 1, wherein the connector release actuator is accessible on at least one outer surface of the connector base and opposite the second end of the connector base from a cable that extends from the second end of the connector base.

5. The connector of claim 1, wherein the connector release system extends from the second end of the connector base and away from the connector base, and wherein the connector release actuator is accessible on at least one outer surface of the connector release system and on the same side of the second end of the connector base as a cable that extends from the second end of the connector base.

6. The connector of claim 1, wherein the connector base is a Registered Jack-45 (RJ-45) connector base.

7. An Information Handling System (IHS), comprising:
a chassis;
a processing system that is housed in the chassis;
a communication system that is housed in the chassis, that is coupled to the processing system, and that includes a port; and
a cable that is coupled to the port via a connector, wherein the connector includes:
a connector base including a first end that is inserted in the port, and a second end that is located opposite the connector base from the first end and that extends from the cable;
a connector release tab that extends from the connector base adjacent the first end and that is configured to move relative to the connector base;
a connector securing feature that is included on the connector release tab and that engages the port to secure the connector base in the port; and
a connector release system that includes:
a connector release linkage that is coupled to the connector release tab and that extends through the connector base; and
a connector release actuator that is located adjacent the second end of the connector base and that is coupled to the connector release linkage, wherein the connector release actuator is configured to be actuated to move, via the connector release linkage, the connector release tab to disengage the connector securing feature from the port such that the connector base may be removed from the port.

8. The IHS of claim 7, wherein the connector release system includes:
a connector release actuator biasing member that is configured to bias the connector release actuator, the connector release linkage, and the connector release tab into a securing orientation that allows the connector securing feature to engage a port to secure the connector base in that port.

9. The IHS of claim 8, wherein the actuation of the connector release actuator overcomes a biasing force provided by the connector release actuator biasing member and moves the connector release actuator, the connector release linkage, and the connector release tab into a release orientation that disengages the connector securing feature from a port such that the connector base may be removed from that port.

10. The IHS of claim 7, wherein the connector release actuator is accessible on at least one outer surface of the connector base and opposite the second end of the connector base from a cable that extends from the second end of the connector base.

11. The IHS of claim 7, wherein the connector release system extends from the second end of the connector base and away from the connector base, and wherein the connector release actuator is accessible on at least one outer surface of the connector release system and on the same side of the second end of the connector base as a cable that extends from the second end of the connector base.

12. The IHS of claim 7, wherein the connector base is a Registered Jack-45 (RJ-45) connector base.

13. The IHS of claim 7, wherein the connector release linkage includes:
a first link that extends from the connector release actuator and through a portion of the connector base; and
a second link that is pivotally coupled to the first link and the connector release tab.

14. A method for releasing a connector, comprising:
engaging, by a connector securing feature included on a connector release tab extending adjacent a first end of a connector base that is inserted in a port, the port
moving, by a connector release actuator located adjacent a second end of the connector base that is opposite the first end and in response to an actuation force, the connector release tab via a connector release linkage that extends through the connector base between the connector release actuator and the connector release tab; and
disengaging, by the connector securing feature in response to the movement of the connector release tab, the port such that the connector base may be removed from the port.

15. The method of claim 14, further comprising:
biasing, by a connector release actuator biasing member, the connector release actuator, the connector release linkage, and the connector release tab into a securing orientation that allows the connector securing feature to engage the port to secure the connector base in the port.

16. The method of claim 15, wherein the actuation of the connector release actuator overcomes a biasing force provided by the connector release actuator biasing member and moves the connector release actuator, the connector release linkage, and the connector release tab into a release orientation that disengages the connector securing feature from the port such that the connector base may be removed from the port.

17. The method of claim 14, wherein the connector release actuator is accessible on at least one outer surface of the connector base and opposite the second end of the connector base from a cable that extends from the second end of the connector base.

18. The method of claim 14, wherein the connector release system extends from the second end of the connector base and away from the connector base, and wherein the connector release actuator is accessible on at least one outer surface of the connector release system and on the same side of the second end of the connector base as a cable that extends from the second end of the connector base.

19. The method of claim 14, wherein the connector base is a Registered Jack-45 (RJ-45) connector base.

20. The method of claim 14, wherein the connector release linkage includes:
a first link that extends from the connector release actuator and through a portion of the connector base; and
a second link that is pivotally coupled to the first link and the connector release tab.

* * * * *